US005890345A

United States Patent [19]

Bauer

[11] Patent Number: 5,890,345

[45] Date of Patent: Apr. 6, 1999

[54] METHOD OF WRAPPING LUGGAGE

[75] Inventor: Donald Gustave Bauer, Leduc, Canada

[73] Assignee: Secure Luggage Systems Inc., Edmonton, Canada

[21] Appl. No.: 978,360

[22] Filed: Nov. 25, 1997

Related U.S. Application Data

[63] Continuation of Ser. No. 670,750, Jun. 21, 1996, abandoned.

[30] Foreign Application Priority Data

Nov. 10, 1995 [CA] Canada ..... 2162637

[51] Int. Cl.[6] ..... B65B 53/02

[52] U.S. Cl. ..... 53/449; 53/411; 53/442; 53/399

[58] Field of Search ..... 190/26, 102; 150/154; 206/459.5, 497; 53/131.2, 131.4, 131.5, 399, 411, 441, 442, 176, 449, 556, 557

[56] References Cited

U.S. PATENT DOCUMENTS

| | | | |
|---|---|---|---|
| 3,331,105 | 7/1967 | Gordon | 28/497 X |
| 3,351,209 | 11/1967 | Kofoed et al. | 206/459.5 X |
| 3,567,108 | 3/1971 | Corridon | 206/459.5 X |
| 3,809,223 | 5/1974 | Kendall | 53/449 X |
| 3,815,313 | 6/1974 | Heisler . | |
| 3,996,719 | 12/1976 | Dabrowski et al. | 53/399 |
| 4,783,950 | 11/1988 | Santagati . | |
| 5,168,691 | 12/1992 | Errani | 53/556 X |
| 5,296,079 | 3/1994 | Romo | 53/587 X |
| 5,299,406 | 4/1994 | Laury . | |
| 5,365,723 | 11/1994 | Ramos | 53/587 X |
| 5,451,282 | 9/1995 | Fore | 53/414 X |
| 5,531,059 | 7/1996 | Dickinson | 53/442 X |
| 5,772,330 | 6/1998 | Bang et al. | 150/154 X |
| 5,784,864 | 7/1998 | Laury | 53/557 |

FOREIGN PATENT DOCUMENTS

WO92/13765 8/1992 WIPO .

*Primary Examiner*—Daniel B. Moon
*Attorney, Agent, or Firm*—Davis and Bujold

[57] ABSTRACT

A method of improving security of a luggage wrapping system. Firstly, apply at least one band around a piece of luggage. Secondly, apply a polymer plastic wrap to the luggage.

4 Claims, 3 Drawing Sheets

METHOD OF WRAPPING LUGGAGE

This application is a continuation of application Ser. No. 08/670,750 filed on Jun. 21, 1996 now abandoned.

FIELD OF THE INVENTION

The present invention relates to a method of wrapping luggage and, in particular, such a method suitable for use as a security measure at an airport.

BACKGROUND OF THE INVENTION

Over the past decade a number of airports have experimented with wrapping luggage in a transparent polymer plastic wrap. When first introduced, this practice was considered to provide a number of advantages. It provided a measure of protection against unauthorized tampering with the luggage. It protected the luggage from scrapes and abrasions during handling. It protected the luggage from water damage from rain or snow encountered during handling.

Two types of luggage wrap are used; a thin ply, cling type of wrap and a heavier ply shrink wrap. The heavier ply shrink wrap has proven to be more effective. It provides a greater measure of protection and a greater degree of tamper resistance. A number of machines for automatically applying protective shrink wrapping have been developed and are described in the patent literature. Each machine has a particular advantage for which patent protection was sought and obtained. U.S. Pat. No. 3,815,313 which issued to Heisler in 1974 discloses a method and apparatus for heat shrinking a film around a piece of luggage and at the same time providing an integrally attached handle to assist with handling. U.S. Pat. No. 4,783,950 which issued to Santagati in 1988 discloses a method and apparatus for detecting the dimensions of a piece of luggage moving along a conveyor toward the heat shrinking equipment and adjust heat sealing rods to accommodate the dimensions with a minimum of wastage. U.S. Pat. No. 5,299,406 which issued to Laury in 1994 discloses an apparatus for shrink wrapping a piece of luggage which leaves an opening to provide access to the luggage handle.

Through experience it has been determined that the wrapping of luggage did not provide the degree of security that was originally envisaged. The criminal element proved capable of keeping up with advances in technology and, when it suited their purpose, resealing the luggage to cover their activities.

SUMMARY OF THE INVENTION

What is required is a method of wrapping luggage that will provide enhanced security.

According to the present invention there is provided a method of improving security of a luggage wrapping system. Firstly, apply at least one band around a piece of luggage. Secondly, apply a polymer plastic wrap to the luggage.

With the method, as described above, the banding of the luggage ensures that persons cannot tamper with the piece of luggage by merely severing the plastic. The banding holds the luggage securely closed and presents one further obstacle to tampering. The presence of the band makes it that much more difficult to hide illicit activities.

Although beneficial results may be obtained through the use of the method, as described above, it is preferred that each piece of luggage have a highly visible means of identification. Even more beneficial results may be obtained when the band is colour coded. A piece of luggage banded with a blue band is immediately noticeable if it is positioned amongst a plurality of other pieces of luggage each of which is banded with a red band.

Although beneficial results may be obtained through the use of the method, as described above, automatic luggage processing machines are plagued with "reading" problems. The reason for this is that it is difficult to achieve consistent positioning of a machine readable label on a piece of luggage. Luggage does not come down a conveyor in a sufficiently consistent position to enable automated luggage handling equipment to read a label or tag. At the present time a swivelling reading head is being used on automated luggage handling equipment with unsatisfactory results. Even more beneficial effects may, therefore, be obtained when the band serves as a substrate for machine readable code. It is preferred that the machine readable code be positioned around the entire circumference of the band. In this way, the machine readable code can be detected by the automated luggage handling equipment regardless of the orientation of the piece of luggage.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method of wrapping luggage will now be described with reference to FIGS. 1 through 4.

Figure 1:
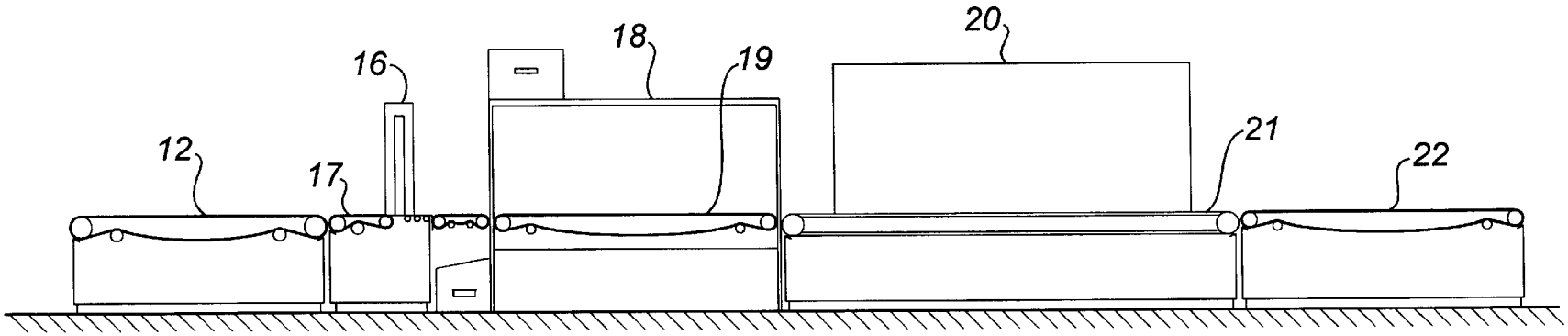
FIG. 1 is a side elevation view of a luggage wrapping system constructed in accordance with the teachings of the present invention.
Figure 2:
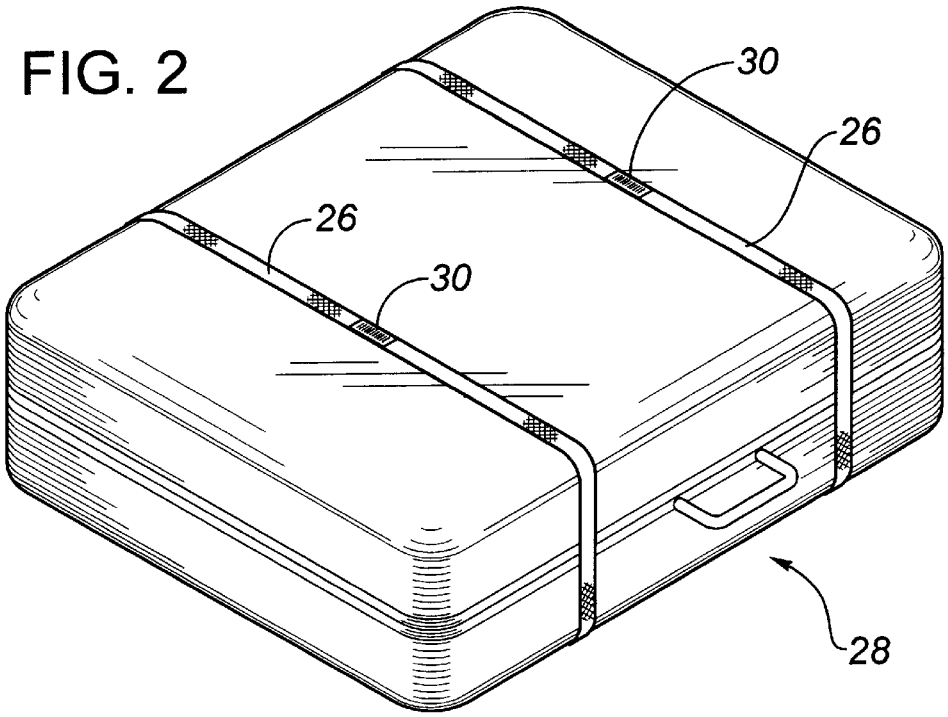
FIG. 2 is a perspective view of a piece of luggage that has undergone a banding step.
Figure 3:
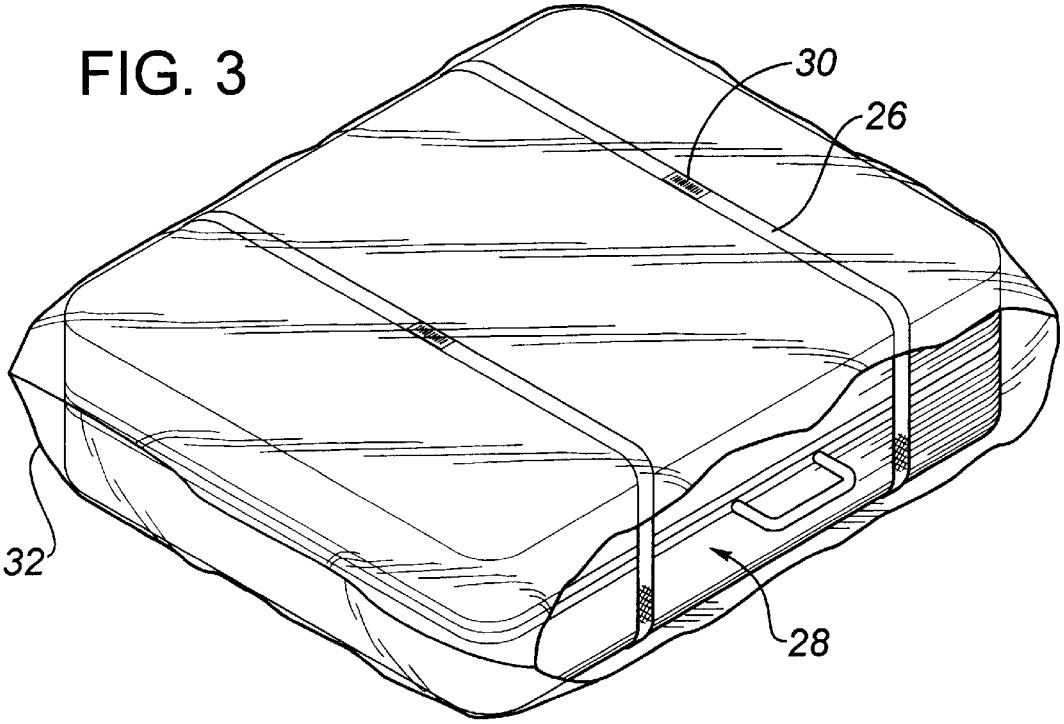
FIG. 3 is a perspective view of a piece of luggage that has undergone a wrapping step.
Figure 4:
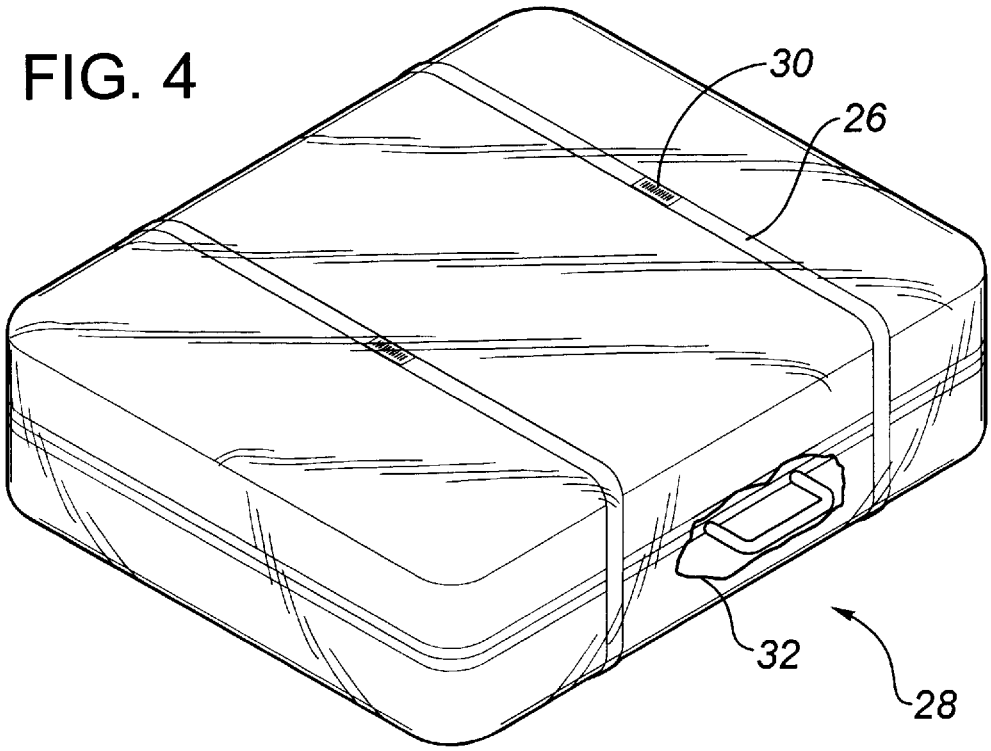
FIG. 4 is a perspective view of a piece of luggage that has been processed in accordance with the described method.

Referring to FIGS. 1, there illustrated the layout of a preferred form of luggage wrapping system. The luggage wrapping system includes are an entry conveyor 12, an automated banding or strapping machine 16 with built in conveyor 17, an automated wrapping machine 18 with built in conveyor 19, a heat shrinking tunnel 20 with built in conveyor 21, and an exit conveyor 22. Referring to FIG. 2, the method includes a step of applying a pair of colour coded bands 26 around a piece of luggage 28. Entry conveyor 12 feeds piece of luggage 28 into automated banding machine 16 where the colour coded bands are applied. FIG. 2 illustrates how piece of luggage 28 appears as it exits automated banding machine carried by built in conveyor 17. Referring to FIG. 4, band 26 serves as a substrate for machine readable code 30, such that band 26 can be used in conjunction with automated luggage handling equipment. Machine readable code 30 is repeated at intervals all around the entire circumference of band 26. This enables machine readable code 30 to be read from a wide variety of potential sensor angles to supplement or replace other forms of labelling. Referring to FIG. 3, the method includes the step of applying a polymer plastic shrink wrap 32 to luggage 28 to encapsulate both luggage 28 and colour coded band 26 to protect luggage 28 and discourage tampering with band 26.

The polymer plastic shrink wrap 32 is applied by automated wrapping machine 18. FIG. 3 illustrates how piece of luggage 28 appears as it exits automated wrapping machine 18 carried by built in conveyor 19. Piece of luggage 28 finally passes through heat shrinking tunnel 20. FIG. 4 illustrates how piece of luggage 28 appears as it exits heat shrinking tunnel 20 carried by built in conveyor 19. From built in conveyor 19, piece of luggage 28 is carried by exit conveyor 22 to a luggage loading area (not shown).

With the method, as described above, coloured band 26 provides an immediate visual confirmation to security personnel that piece of luggage 28 has been pre-inspected. The positioning of band physically prevents piece of luggage 28 from being opened. Colour coding is used to indicate the origin of piece of luggage 28 and its routed destination. It also provides the necessary assurance that the last person to have access to piece of luggage 28 was the individual traveller who checked in piece of luggage 28. A piece of luggage 28 in the wrong area is immediately noticeable to security personnel as it is banded with a band 26 that differs in colour from the bands 26 on the other pieces of luggage 28 in that area. The shrinking wrapping of polymer plastic wrap 32 around piece of luggage 28 ensures that there is no access to band 26 without tampering becoming readily evident. In other words, the bands 26 cannot be removed or slid off one end until polymer plastic shrink wrap 32 has first been removed. Having machine readable code 30 on band 26 facilitates movement of piece of luggage 28 through automated luggage handling systems. Machine readable code 30 on band 26 can be in substitution for or in addition to machine readable labels applied directly onto polymer plastic wrap 32. The problem with such machine readable labels used without machine readable code 30 on band 26 being that a plurality of them are required in various positions in order to ensure they are accessible to be read regardless of the positioning of piece of luggage 28 as it travels along a conveyor of an automated luggage handling system.

It has been determined that banding machines used in factories to close and band packing boxes, and for other purposes exert too great a pressure for use with a luggage wrapping system such as has been described. It has been found necessary to modify the feed and tensioning mechanisms from such banding machines to avoid damage to the luggage. The compression force necessary and desirable in other banding applications is counter-productive in this application.

It will be apparent to one skilled in that art that banding and wrapping luggage 28 accomplishes a greater measure of security than could ever be possible by wrapping alone. It will also be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of wrapping luggage, comprising the steps of:

firstly, providing an automated banding machine, an automated wrapping machine, a shrink wrap tunnel and means for conveying a piece of luggage;

secondly, conveying a piece of luggage through the automated banding machine and applying at least one band around the piece of luggage so as to preclude opening of the luggage;

thirdly, conveying the piece of luggage through the automated wrapping machine and applying a polymer plastic shrink wrap to the piece of luggage;

fourthly, conveying the piece of luggage through the shrink wrap tunnel and heating the shrink wrap until it closely adheres to the piece of luggage thereby encapsulating both the luggage and the at least one band within protective polymer plastic.

2. The method as defined in claim 1, wherein the band is colour coded.

3. The method as defined in claim 1, wherein the band serves as a substrate for machine readable code.

4. The method as defined in claim 3, wherein the machine readable code is positioned around the entire circumference of the band, such that the machine readable code is readable from a wide variety of potential sensor angles.

* * * * *